United States Patent [19]

Dewhurst

[11] Patent Number: 4,512,443

[45] Date of Patent: Apr. 23, 1985

[54] LIFT DOOR CONTROL APPARATUS

[75] Inventor: Alan Dewhurst, Hounslow, England

[73] Assignee: Dewhurst & Partner P.L.C., Hounslow, England

[21] Appl. No.: 476,564

[22] Filed: Mar. 18, 1983

[30] Foreign Application Priority Data

Mar. 24, 1982 [GB] United Kingdom ..... 8208692

[51] Int. Cl.[3] ..... B66B 13/20

[52] U.S. Cl. ..... 187/57; 187/61

[58] Field of Search ..... 187/56, 57, 61

[56] References Cited

U.S. PATENT DOCUMENTS 3,878,919 4/1975 Dewhurst ..... 187/57 X 4,364,454 12/1982 Glaser et al. ..... 187/57

FOREIGN PATENT DOCUMENTS 111607 8/1964 Czechoslovakia ..... 187/56

*Primary Examiner*—Joseph J. Rolla

*Assistant Examiner*—Frederick R. Handren

*Attorney, Agent, or Firm*—Laubscher, Philpitt & Laubscher

[57] ABSTRACT

A lift door control apparatus including a door locking mechanism and a release mechanism for releasing the door locking mechanism. The release mechanism comprises a release arm coupled to the shaft of an electromagnetic actuator. When the actuator is de-energized it is held in a first position in which the arm is engageable with a floor ramp when the lift car is at a floor. When the actuator is energized the arm is held in a second position in which it is held out of engagement with any floor ramp. Two finger members are mounted on the actuator shaft and arranged to be moved towards one another at their mounted ends so that their free ends engage one another and move outwardly away from the shaft when the actuator is de-energized and the release arm engages a floor ramp. This movement provides a release impetus to the door locking mechanism. The door locking mechanism may include a spring for mechanically operating the lift door operating mechanism in the event of power failure.

6 Claims, 2 Drawing Figures

LIFT DOOR CONTROL APPARATUS

BACKGROUND OF THE INVENTION

This invention relates to lift door control apparatus.

It is the practice to control the operation of electrically-operated lift car doors to ensure that they do not open when the car is between floors, either during normal operation or in the event of a power failure. This is normally achieved by an arrangement including a release arm mounted on the car which engages with ramps located one at each floor. Unless the release arm is engaged and deflected by a ramp, the door operating mechanism is locked and disabled.

In the event of a power failure, if the car is winched to a floor the release arm will be deflected by the floor ramp and unlock the door operating mechanism. However, there will be no power to energise the operating mechanism. It is common practice to design such door operating mechanism so that there is a strong mechanical resistance to any attempt to initiate opening of the door manually. This is achieved by arranging for the radius arm of the operating mechanism to be at or near a top-dead-center position in relation to its associated drive wheel, such arrangements being well-known and not requiring further description. The resulting situation is that assistance must be called to apply a strong force to the door, as by employing a crow-bar, with the consequent delay in releasing the car passengers and inevitable damage to the car door and operating mechanism.

Furthermore, it is also common practice to provide that while the car is travelling through intermediate floors to its selected destination floor during normal operation, the release arm is held by an electro-magnetic actuator in a retracted position in which it will not engage the ramps of intermediate floors.

SUMMARY OF THE INVENTION

With the aforementioned considerations in view, an object of the present invention is to provide an improved lift door control apparatus.

A further object of the invention is to provide such an apparatus which, in the event of power failure, will initiate opening of the door when the car is at a floor.

In accordance with the invention, there is provided a lift door control apparatus including a door locking mechanism and a release mechanism for releasing said door locking mechanism, the release mechanism comprising a release arm coupled to the shaft of an electromagnetic actuator so that when the actuator is de-energized the arm is held in a first position in which the arm is engageable with a floor ramp when the lift car is at a floor and so that when the actuator is energized the arm is held in a second position in which the arm is held out of engagement with any floor ramp, and further comprising a pair of finger members mounted on the actuator shaft and arranged to be moved towards one another at their mounted ends so that their free ends engage one another and move outwardly away from the shaft when said actuator is de-energised and the release arm engages a floor ramp, the outward movement of the free ends of the finger members providing a release impetus to the door locking mechanism.

Preferably, the door locking mechanism is adapted to co-operate with the radius arm of the lift door operating mechanism so as to lock the radius arm against movement when the lift door is closed, the door locking mechanism comprising means for applying a force to the radius arm such that when the door locking mechanism is released the radius arm is unlocked and moved by the force, thereby causing the door operating mechanism to operate and initiate opening of the lift door.

BRIEF DESCRIPTION OF THE FIGURES

One embodiment of the invention will now be described by way of example only, with reference to the accompanying drawings in which.

DETAILED DESCRIPTION

Figure 1:
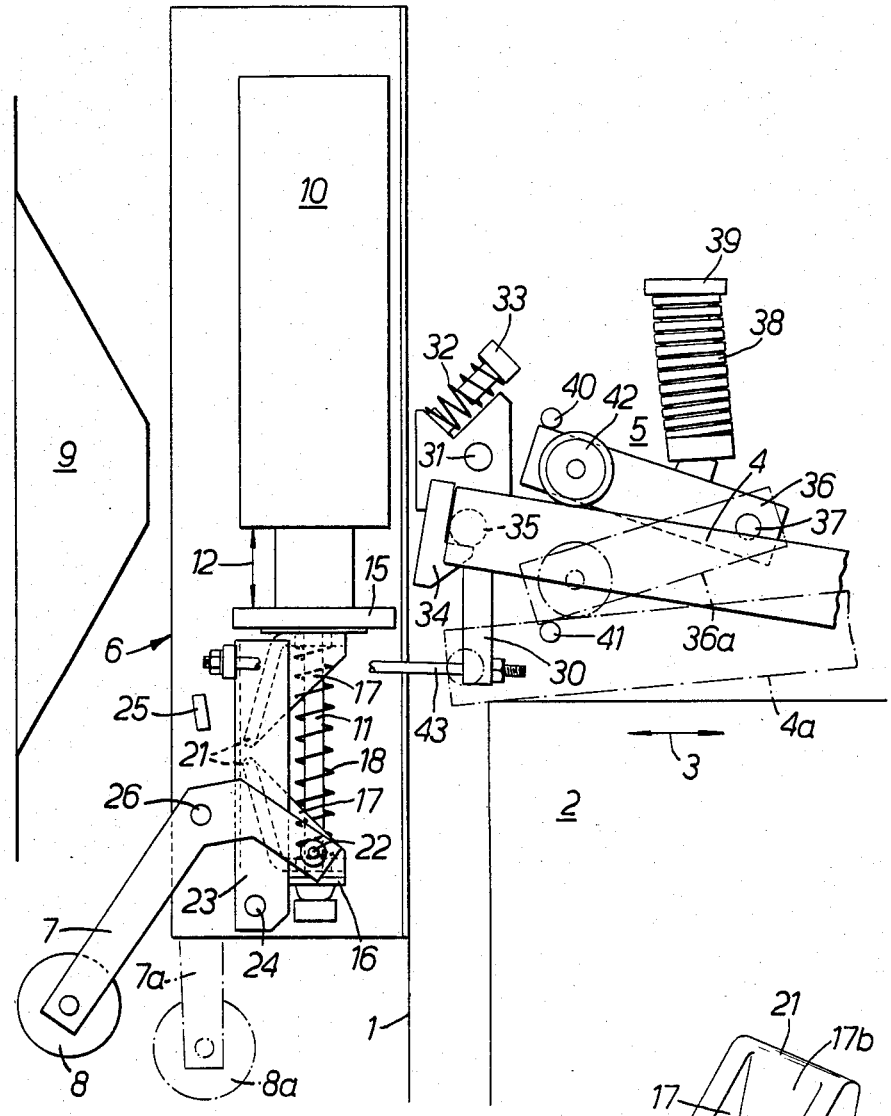
FIG. 1 is a diagrammatic representation of lift door control apparatus in accordance with the invention.

Referring to FIG. 1, a lift car has an external side surface 1 and a door 2 slidable in the directions indicated by the arrows 3. Mechanism for operating the door (not otherwise shown) includes a radius arm 4 located above the door. Associated with the radius arm is a door locking mechanism generally referenced 5 which is released or locked by a release mechanism generally referenced 6 and mounted on the side 1 of the car. The release mechanism includes a release arm 7 provided at one end with a roller 8 which is engageable with a floor ramp 9.

The release mechanism comprises an electro-magnetic actuator 10 having a shaft 11 which moves over a distance indicated by the arrows 12 between a lower position as shown in the drawing, in which the actuator is de-energized, and an upper position in which the actuator is energized and the release arm 7 is retracted to the position indicated by broken lines **7*a* and 8*a* in which said arm and roller 8 are held out of engagement with the ramp 9. Secured to the shaft 11 is a circular plate 15 and, at the lower end, a circular plate 16**.

Mounted on the shaft 11 is a pair of finger members 17 spaced apart and retained against the respective plates 15, 16 by a helical spring 18. The finger members have the form shown in FIG. 2 and preferably are a one-piece molding of a suitable material, e.g. glass-filled nylon. Each finger member comprises a base portion **17*a* and a finger portion 17*b* projecting from the base element, the latter having an elongated hole 20 through which the actuator shaft passes, the hole having a minimum diameter substantially larger than the diameter of the actuator shaft. The edge 21 constitutes the free end of the finger member when mounted on the shaft. Bosses 22 are formed on the sides of the finger member, at least the lower most member as seen in FIG. 1**.

The free ends 21 of the finger members lie adjacent each other within a channel-shaped lever 23 which is pivotally mounted at 24 and is movable counter-clockwise between the position shown and a stop member 25. The pivot 24 and stop member 25 are secured to the housing of the release mechanism. Also secured to the housing is a pivot 26 carrying the release arm 7, which is part of a bifurcated bell-crank lever the ends of which remote from the roller 8 are journalled on the bosses 22 of the lower finger member.

In operation of the release mechanism, when the actuator 10 is energised the shaft moves upwardly by the distance indicated by the arrows 12. The finger members 17 and spring 18 are carried up with the shaft without any relative movement of the finger members, the free ends 21 of the finger members sliding within the channel-shaped lever 23 which remains stationary. The release arm 7 is pivoted counter-clockwise to the position *7a*.

Figure 2:
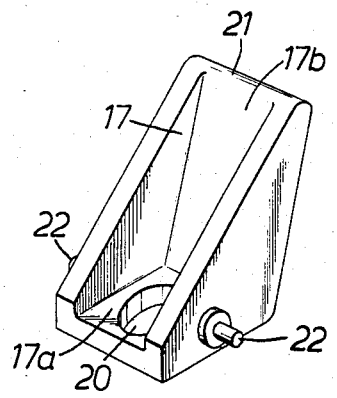
FIG. 2 is a perspective view of a finger member constituting a part of the apparatus of FIG. 1.

With the actuator de-energized as shown, when the roller 8 engages the lift ramp 9 the release arm is rotated to the position *7a* and, through the journals 22, moves the lower finger member 17 up the actuator shaft towards the upper finger member, compressing the spring 18. The actuator shaft remains in its lower most position due to gravity. When the free ends 21 of the finger members engage one another, the further movement of the lower finger member causes the finger members to rock on the actuator shaft, which is possible due to their loose fit on the shaft and the elongation of the holes 20 (FIG. 2). The free ends of the finger members move outwardly away from the actuator shaft and act upon the channel-shaped lever 23 which is pivoted counter-clockwise to abut the stop member 25. This outward movement of the finger members provides a release impetus to the door locking mechanism, as will now be described.

The door locking mechanism 5 comprises a lever 30 pivoted at 31 and biassed in an counter-clockwise direction by a spring 32 acting against a boss 33. A catch 34 is rigidly secured to the lever 30 and, in the door-locked condition, engages the radius arm 4 of the door operating mechanism through a needle bearing 35 mounted on the radius arm. The mechanism 6 also includes a lever 36, shown located behind the radius arm, pivoted at 37. A helical spring 38, shown compressed, acts on the lever 36 and against a boss 39. Pivotal movement of the lever 36 is limited by stop members 40 and 41. It is to be understood that the pivots 31 and 37, the bosses 33 and 39 and the stop members 40 and 41 are secured to the framework (not shown) of the mechanism. Rotatably mounted at the free end of lever 36 is a rubber-rimmed wheel 42 which bears upon the radius arm 4.

The release mechanism 6 is connected to the locking mechanism 5 by a tie rod 43 (shown partly broken away for clarity) secured to the free ends of levers 23 and 30.

The force of spring 32, in the locking mechanism, acts through lever 30 and the tie rod 43 to retain lever 23 in the position shown. With actuator 10 de-energized, when the release arm 7, through its roller 8 engages a ramp 9, the free ends of the finger members move outwardly and pivot lever 23 to abut the stop member 25. This movement is transmitted through the tie rod 43 to pivot lever 30 clockwise against the force of sprinbg 32, which releases catch 34 from the bearing 35 and thus unlocks the radius arm 4. That, in itself, would merely leave the radius arm in the position shown and in a power-failure situation the arm would not move, so that the lift door would remain firmly closed. However, due to the force of the compressed spring 38, lever 36 and the radius arm 4 are moved to the respective positions 36*a* and 4*a* indicated by broken lines. This movement of the radius arm drives the door operating mechanism mechanically to initiate door opening and move the door to a position in which the door edge may be gripped and manually opened to its full extent.

It will be understood that when the door operating mechanism is driven under normal conditions to close the lift door, the force transmitted to the radius arm is sufficient to re-compress spring 38 before the radius arm is locked by the latch 34, the actuator 10 having been energized.

The present invention, in its broadest aspect, is not limited to the control of electrically-operated lift doors. A manually-operated lift door may be controlled by replacing the door locking mechanism 6 by a simple catch device constituting the door locking mechanism and directly connected to the tie-rod 43.

I claim:

1. Apparatus for controlling the movement of a lift car door relative to a lift car, comprising (a) door locking means operable between locked and normally unlocked conditions;

(b) latch means operable between normally unlatched and latched conditions in which said door locking means is in the unlocked and locked conditions, respectively;

(c) means for releasing said latch means when said lift car is at a given position relative to a floor, said release means including (1) a release arm pivotally connected intermediate its ends with said lift car for pivotal movement between retracted and normally extended positions relative to the car, one end of said release arm, when in the extended position, being arranged for engagement by a stationary floor ramp adjacent the floor for pivoting said release arm to said retracted position;

(2) a latch release lever pivotally connected with said lift car for movement between normal first and second positions relative to said car;

(3) means connecting said latch lever with said latch means to cause said latch means to be in the latched and unlatched conditions when said latch release lever is in said first and second positions, respectively; and (4) means connected with the other end of said release arm for pivoting said latch release lever to the second position when said release arm is pivoted to the retracted position, said latch release lever pivoting means including (a) an electromagnetic actuator connected with said lift car and including an actuator shaft operable between extended and retracted positions when said actuator is de-energized and energized, respectively;

(b) a pair of finger members each having base and finger portions, said base portions containing enlarged openings for loosely mounting said finger members for sliding and pivotal movement on said shaft with the finger portions extending toward each other; and (c) spring means biasing said finger members apart, one of said finger members being connected with said other end of said release arm to effect relative displacement of said finger members toward each other and subsequent pivoting of said latch release lever to its second position when the release arm is displaced to its retracted position;

(d) said electromagnetic actuator being energizable to retract said shaft to the retracted position and thereby pivot said release arm to its retracted position without relative displacement of said fingers and without operation of said latch release lever.

2. Apparatus as defined in claim 1, wherein said release arm comprises bell crank lever means, and further wherein said bell crank lever means is journaled with said one finger member mounted at the remote end of said shaft.

3. Apparatus as defined in claim 1, wherein each finger member comprises a one-piece molding.

4. Apparatus as defined in claim 1, wherein said latch release lever contains a channel for receiving the displaced unmounted ends of said finger members.

5. Apparatus as defined in claim 1, wherein said latch means is connected with the radius arm of a door operating mechanism for preventing movement of said radius arm when the door is closed, said door locking means comprising spring means for normally biasing the radius arm to a release position, whereby when said door locking means is released, the radius arm is unlocked and moved by the force to cause the door operating mechanism to initiate opening of the door.

6. Apparatus as defined in claim 5, wherein said latch release lever contains a channel for receiving the displaced unmounted ends of said finger members.

* * * * *